US006629443B2

(12) United States Patent
Chin

(10) Patent No.: US 6,629,443 B2
(45) Date of Patent: Oct. 7, 2003

(54) ERGONOMIC CRIMPING APPARATUS

(76) Inventor: Yen Chao Chin, No. 15, Lane 21, Yen Ho RD., Tu Cheng City, Taipei Hsien (TW)

( * ) Notice: Subject to any disclaimer, the term of this patent is extended or adjusted under 35 U.S.C. 154(b) by 0 days.

(21) Appl. No.: 10/046,391

(22) Filed: Jan. 16, 2002

(65) Prior Publication Data

US 2003/0131647 A1 Jul. 17, 2003

(51) Int. Cl.[7] ..... H01R 43/042

(52) U.S. Cl. ..... 72/409.12; 72/409.01; 81/313; 29/751

(58) Field of Search ..... 72/409.07, 409.12, 72/409.01, 409.16; 81/313; 29/751

(56) References Cited

U.S. PATENT DOCUMENTS 2,696,747 A * 12/1954 Bergan ..... 72/409.12
3,212,317 A * 10/1965 Lynch ..... 81/313
3,514,990 A * 6/1970 Bauknight ..... 72/409.12
4,526,070 A * 7/1985 Wiener et al. ..... 72/409.12
5,012,666 A * 5/1991 Chen et al. ..... 72/409.01
5,280,716 A * 1/1994 Ryan et al. ..... 72/409.07
6,161,416 A * 12/2000 Wilhelm et al. ..... 72/409.08
6,289,712 B1 * 9/2001 Beetz et al. ..... 72/409.16
6,508,149 B1 * 1/2003 Heggemann et al. ..... 81/313

* cited by examiner

*Primary Examiner*—Daniel C. Crane
(74) *Attorney, Agent, or Firm*—Rosenberg, Klein & Lee

(57) ABSTRACT

This invention provides an improved crimp tool. The improved crimp tool includes a fixed jaw assembly consisting of two connected halves and a chamber therebetween, wherein one end of the fixed jaw assembly is a fixed jaw and the other end is a first handle, a movable jaw assembly positioned in the chamber, wherein the movable jaw assembly comprises a movable jaw pivotally mounted thereon; a second handle having one end pivotally connected to the movable jaw assembly; a connecting rod positioned in the chamber and the connecting rod having one end pivotally connecting to the second handle and the other end connecting to the fixed jaw assembly; and a ratchet mechanism installed between the fixed jaw assembly and the second handle.

6 Claims, 7 Drawing Sheets

ERGONOMIC CRIMPING APPARATUS

BACKGROUND OF THE INVENTION

1. Field of the Invention

The present invention relates to a crimp tool, and more particularly, to an ergonomic crimping apparatus for steadily fastening a terminal onto a wire with ease.

2. Description of the Prior Art

Typically, a crimp tool is used to fasten a terminal onto a wire. FIG. 1 and FIG. 2 illustrate a prior art crimp tool. As shown in FIG. 1, the crimp tool includes a fixed jaw 10*a* and a movable jaw 11*a*. Die 12*a* and 13*a* are installed on the distal ends of the fixed jaw 10*a* and movable jaw 11*a*, respectively. The fixed jaw 10*a* is connected to a handle 14*a* and the movable jaw 11*a* is pivotally coupled with a handle 15*a*. In use, as shown in FIG. 2, a user presses the handle 15*a* that actuates the movable jaw 11*a* to move toward the fixed jaw 10*a*. By this way, the terminal (not shown) gripped by the die 13*a* of the movable jaw 11*a* may be crimped by the die 12*a*.

Still referring to FIG. 1 and FIG. 2, the prior art crimp tool further includes a ratchet mechanism 16*a* mounted between the fixed jaw 10*a* and the handle 15*a*. When the handle 15*a* is pressed, the ratchet provides repeatable terminations. The handle 15*a* is not released until that the handle 15*a* cannot be pressed further.

However, the prior art encounters several drawbacks. First, a larger stress is required to actuate the movable jaw 11*a*. Second, precise fastening onto the wire is somewhat not easy to be achieved, since the terminal to be fastened onto the wire is typically gripped by the die 13*a* of the movable jaw 11*a*.

SUMMARY OF THE INVENTION

It is a primary object of the present invention to provide an improved crimp to solve the above-mentioned problems.

According to the claimed invention, the improved crimp tool, comprising a fixed jaw assembly consisting of two connected halves and a chamber therebetween, wherein one end of the fixed jaw assembly is a fixed jaw and the other end is a first handle; a movable jaw assembly positioned in the chamber, wherein the movable jaw assembly comprises a movable jaw pivotally mounted thereon; a second handle having one end pivotally connected to the movable jaw assembly; a connecting rod positioned in the chamber and the connecting rod having one end pivotally connecting to the second handle and the other end connecting to the fixed jaw assembly; and a ratchet mechanism installed between the fixed jaw assembly and the second handle.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
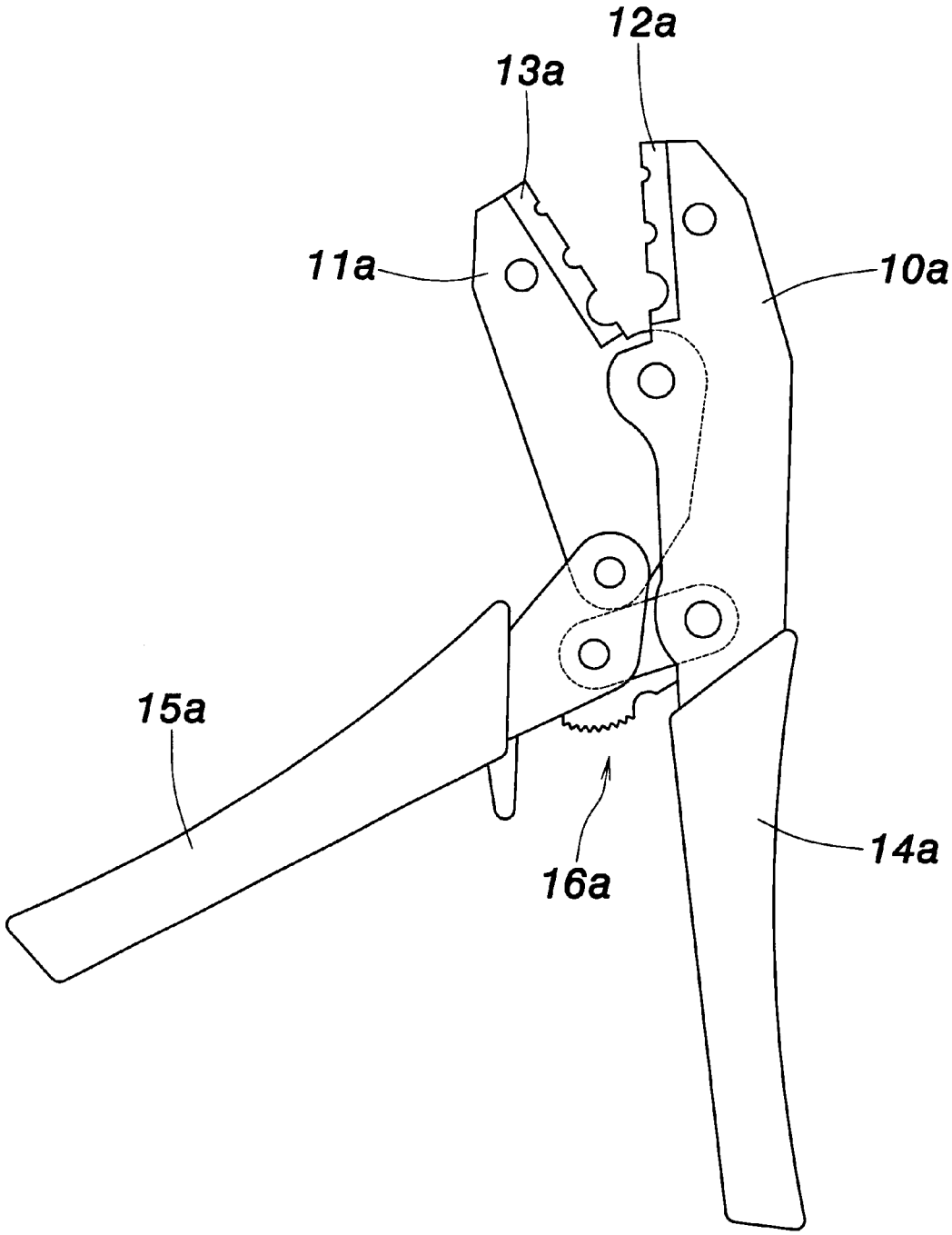
FIG. 1 PRIOR ART
FIG. 1 and FIG. 2 illustrate a prior art crimp tool.
Figure 2:
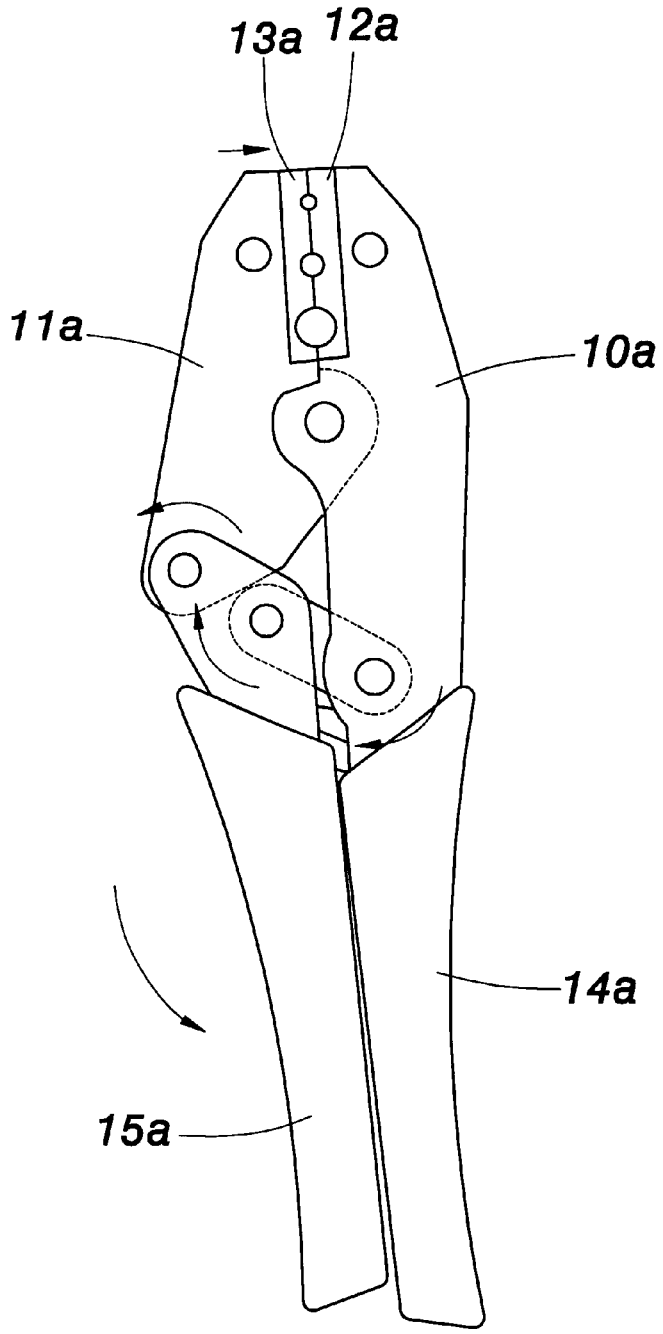
FIG. 2 PRIOR ART
Figure 3:
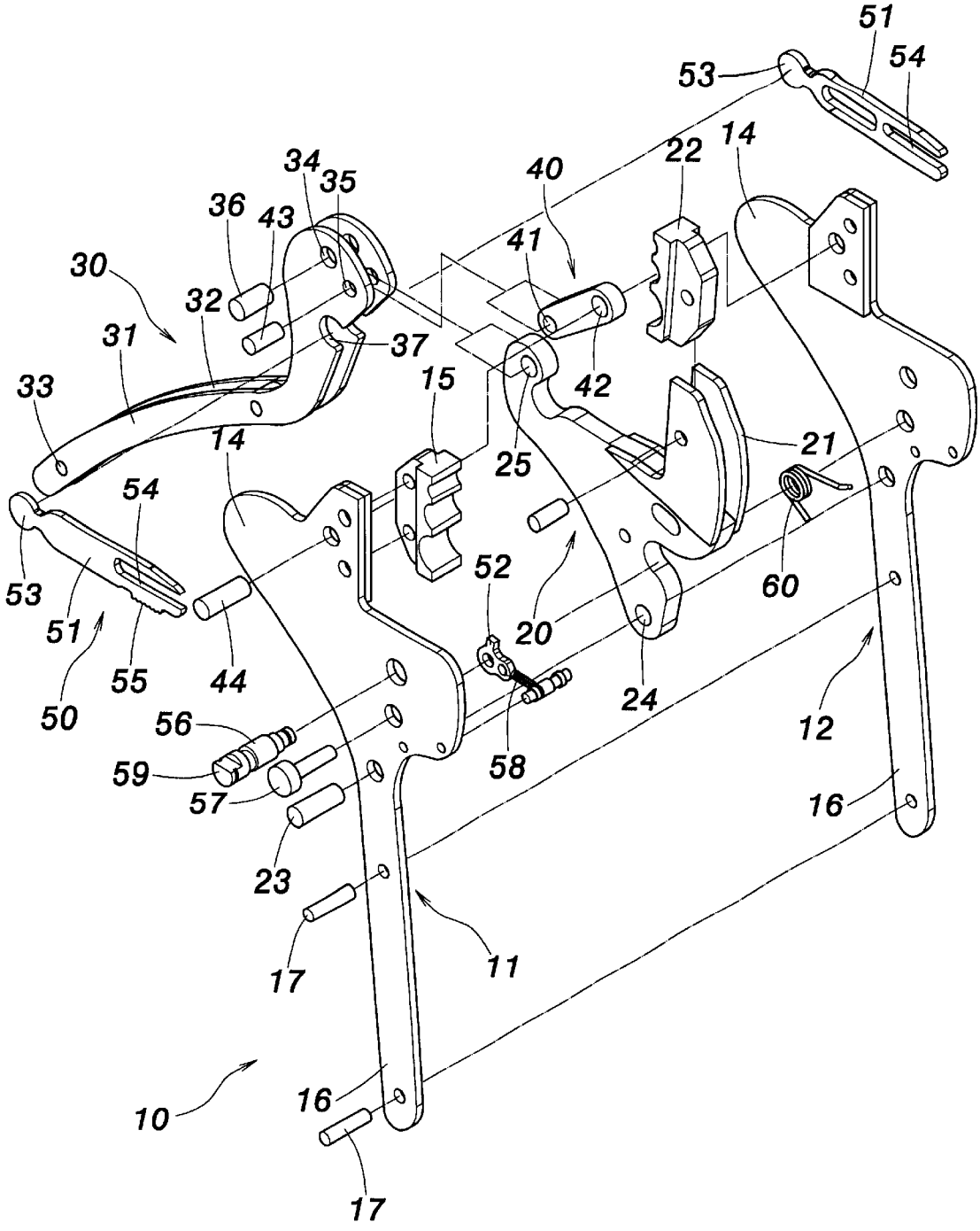
FIG. 3 is an exploded diagram of the crimp tool according to the present invention.
Figure 4:
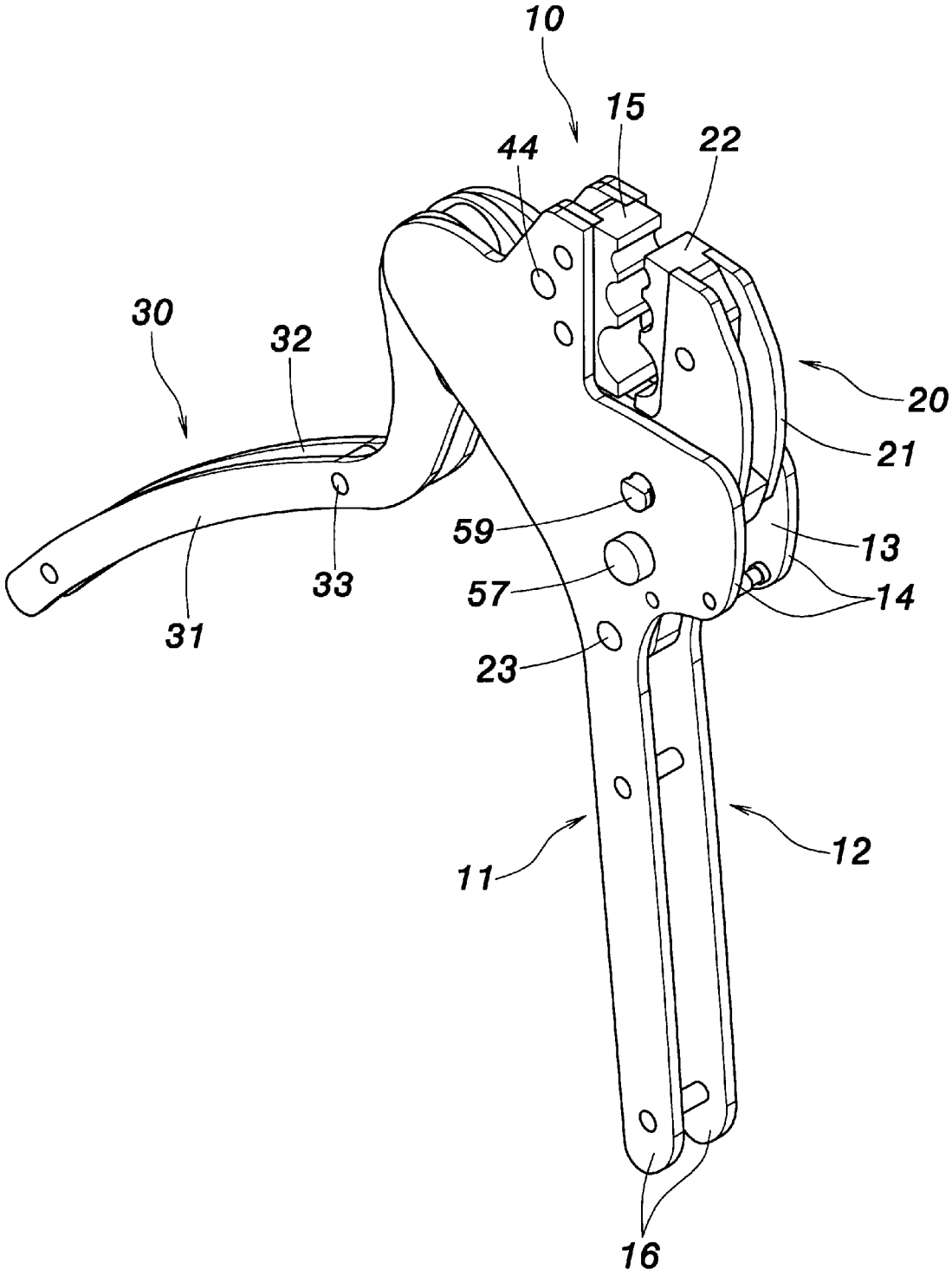
FIG. 4 is perspective view of the crimp tool after assembling.
Figure 5:
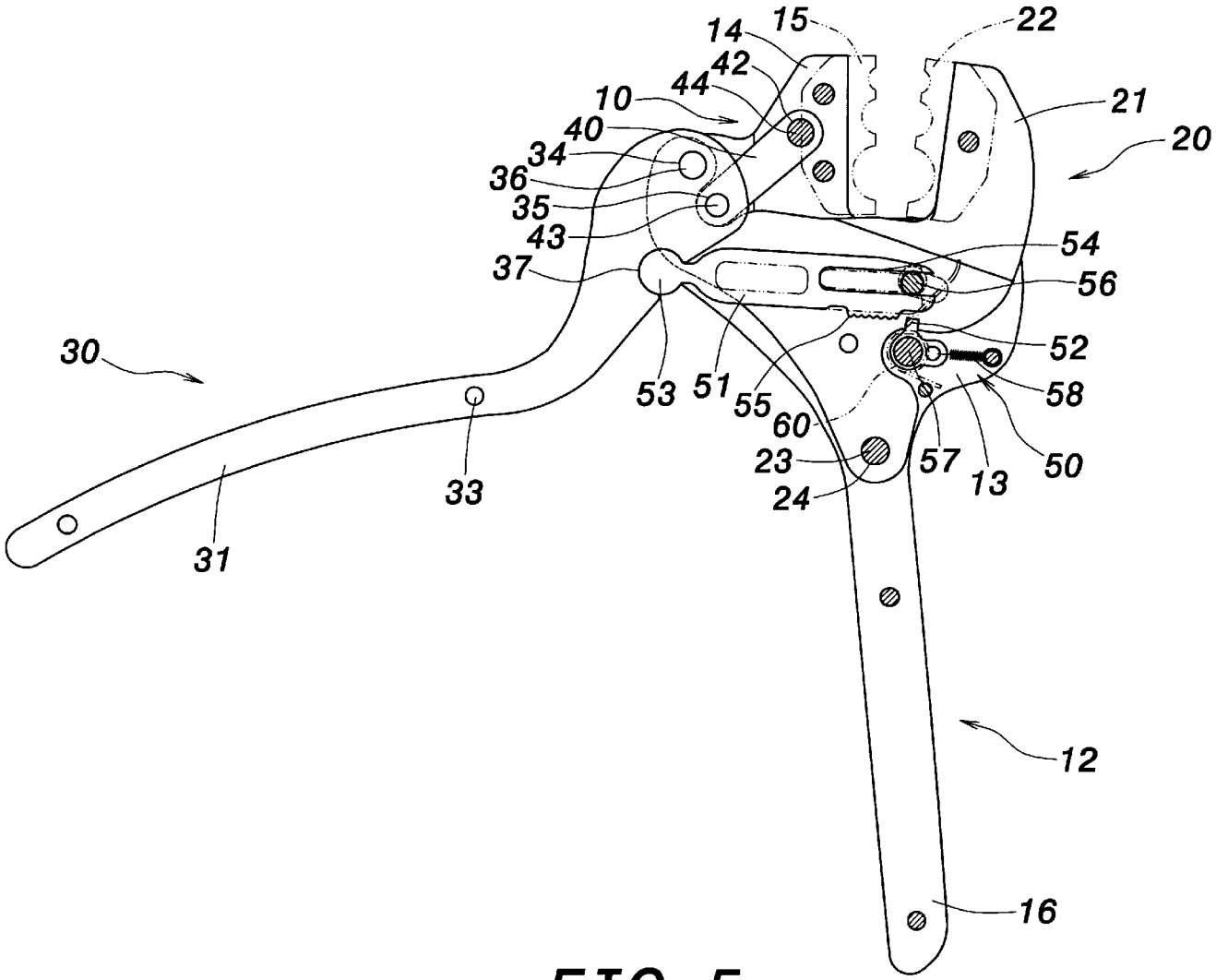
FIGS. 5–7 shows side views of the structure of the crimp tool according to this invention.

This invention provides an improved crimp tool. Please refer to FIG. 3 to FIG. 5, where FIG. 3 is an exploded diagram of the crimp tool according to the present invention, FIG. 4 is perspective view of the crimp tool after assembling, and FIG. 5 is a side view showing the structure of the crimp tool of this invention. As shown in FIG. 3, the crimp tool includes a fixed jaw assembly 10, a movable jaw assembly 20, a handle 30, a connecting rod 40, and a ratchet mechanism 50. The fixed jaw assembly 10 comprises two halves 11 and 12 that are spaced apart and have corresponding structures. More specifically, the halves 11 and 12 are combined by several joint members 17 so as to create a chamber 13 therein. The movable jaw assembly 10 is integrally formed and has fixed jaw end 14 for mounting a die set 15. The die set 15 is interchangeable depending on different purposes. The other end of the movable jaw assembly 10 is a handle 16.

The movable jaw assembly 20 is mounted in the chamber 13 defined by the two halves 11 and 12 of the fixed jaw assembly 10. The movable jaw assembly 20 includes a movable jaw end 21 having a recess for installing a die set 22. The die set 22 corresponds to the die set 15 installed on the fixed jaw assembly 10. Similarly, the die set 22 is interchangeable depending on different purposes. The movable jaw assembly 20 a first pivot hole 24 positioned at one end of the movable jaw assembly 20. The movable jaw assembly 20 is coupled with the fixed jaw end 14 between the fixed jaw assembly 10 and the handle 16 by passing a first pivot pin 23 through the first pivot hole 24. By this way, the movable jaw assembly 20 may swing around the first pivot pin 23. The movable jaw assembly 20 further comprises a second pivot hole 25 positioned at it's the other end.

The handle 30 is comprised of two halves 31 and 32 that have similar shapes corresponding to each other. The two halves 31 and 32 are combined with several joint members 33. A third pivot hole 34 and a fourth pivot hole 35 are positioned at one end of the handle 30. The handle 30 and the movable jaw assembly 20 are coupled by passing a second pivot pin 36 through the third pivot hole 34 and the second pivot hole 25 of the movable jaw assembly 20.

The connecting rod 40 is also mounted in the chamber 13 of the fixed jaw assembly 10. A fifth pivot hole 41 and a sixth pivot hole 42 are formed at opposite ends of the connecting rod 40 as illustrated. When assembling, the connecting rod 40 is coupled with the handle 30 by passing a third pivot pin 43 through the fifth pivot hole 41 of the connecting rod 40 and the fourth pivot hole 35 of the handle 30. The other end of the connecting rod 40 is coupled with the fixed jaw end 14 of the fixed jaw assembly 10 by passing a fourth pivot pin 44 through the sixth pivot hole 42. By this way, the handle 30 is connected with the fixed jaw assembly 10.

The ratchet mechanism 50 is mounted between the fixed jaw assembly 10 and the handle 30 within the chamber 13 of the fixed jaw assembly 10. The ratchet mechanism 50 includes a pair of ratchet members 51 and a stopper 52. Each of the ratchet members 51 has a rounded connecting end 53 that engages with a semicircle-shaped recess 37 formed at one end of the handle 30. The semicircle-shaped recess 37 may stop rounded connecting end 53 of the ratchet members 51 during its swing, thereby limiting the swinging distance of one end of the ratchet members 51 and angle of the handle 30. Each of the ratchet members 51 has a guiding groove 54. One of the ratchet members 51 has a plurality of ratchets 55 thereon. The guiding groove 54 is coupled with a guiding piece 56 with one offset-axial end and the guiding piece 56 is incorporated with an adjusting wheel device 59. As illustrated, the guiding piece 56 is pivotally mounted on the fixed jaw assembly 10. By rotating the adjusting wheel device 59 the offset-axial guiding piece 56 may upwardly contact an interior surface of the guiding groove 54, and thus different swing angle of the ratchet members 51 may be achieved. Further, a flexible device 60 such as a torsion spring is provided between the ratchet members 51 and the fixed jaw assembly 10. The flexible device 60, which when assembling contacts with one end of the ratchet members 51, is used to provide a back positioning force or reverse force for repositioning the ratchet members 51.

Pressing the handle 30 actuates the movement of the ratchet members 51. When the ratchet members 51 move in response to handle 30, the ratchet members 51 move along path guided by the guiding piece 56. As illustrated in FIG. 3, the stopper 52 is mounted on a fifth pivot pin 57 that is pivotally mounted on the fixed jaw assembly 10. The fifth pivot pin 57 has a bottom end with larger diameter for rotating operations. A flexible device 58 such as a stretch spring is connected to one end of the stopper 52. The other end of the flexible device 58 is fixed on the fixed jaw assembly by a suitable means. By the stretching of the flexible device 58 the stopper 52 flexibly snaps the ratchets 55 of the ratchet members 51.

As mentioned, by rotating the adjusting wheel device 59 the offset-axial guiding piece 56 may upwardly contact an interior surface of the guiding groove 54, and thus different swing angle of the ratchet members 51 may be achieved. Gap between the ratchets 55 of the ratchet members 51 and the stopper 52 is therefore adjustable. By this way, suitable interaction and tightness between the stopper 52 and the ratchets 55 of the ratchet members 51 may be maintained.

In use, the fifth pivot pin 57 may serve as a rotating bottom. When rotating the fifth pivot pin 57 the stopper 52 may selectively snaps the ratchets 55 of the ratchet members 51 or it may disengage with the ratchets 55 of the ratchet members 51. In the later case, it permits the opening of the handle 30.

Figure 6:
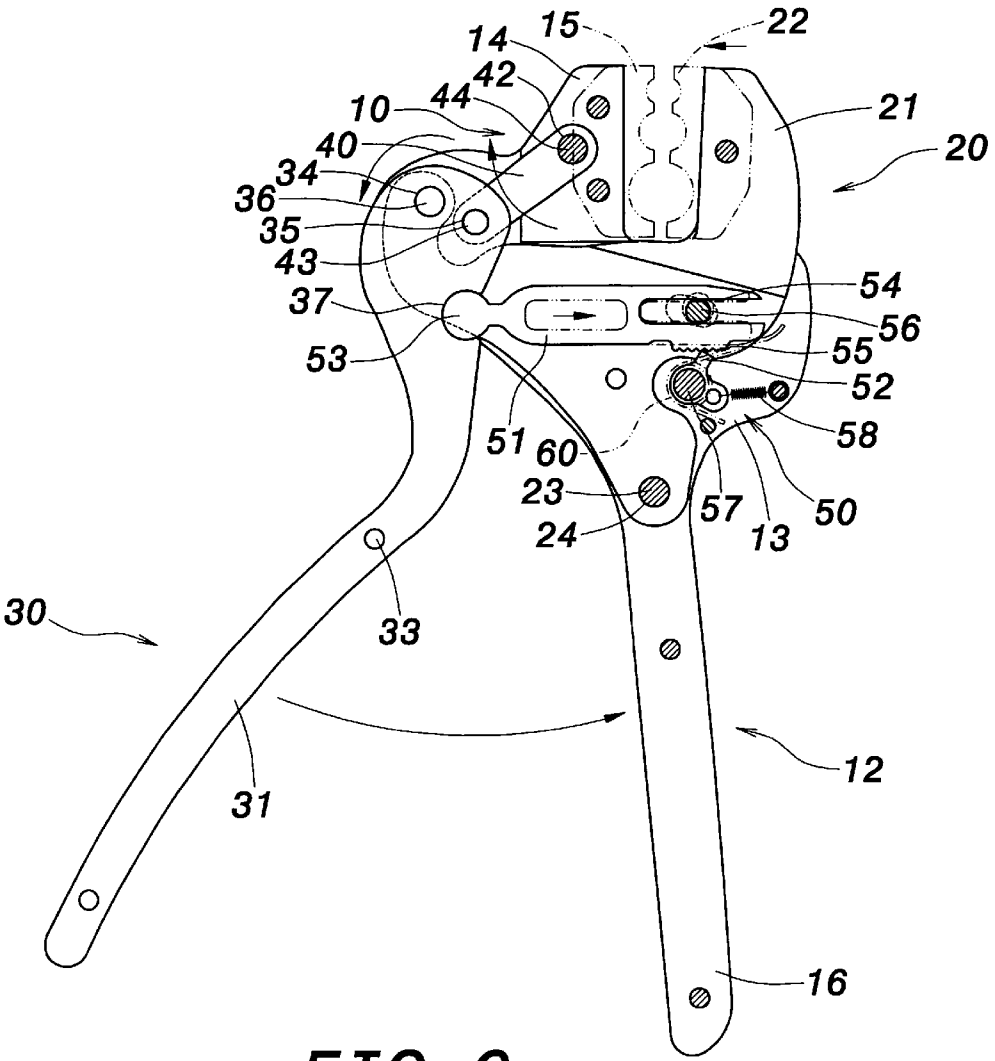
Figure 7:
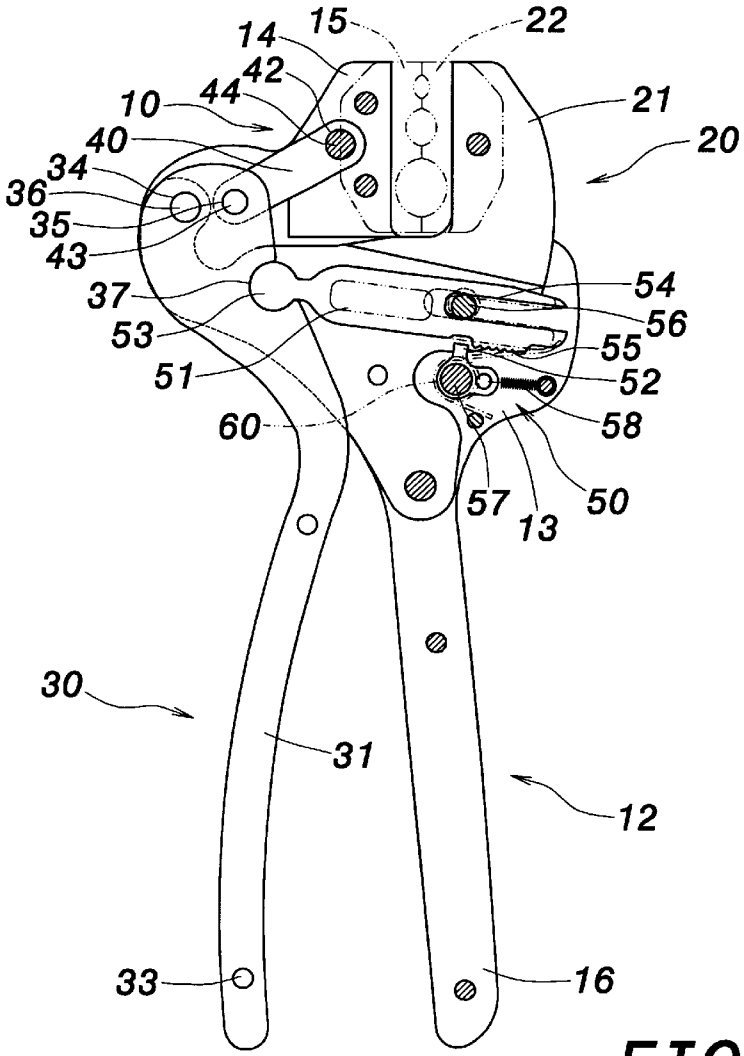

Referring to FIG. 5 to FIG. 7, when a user presses the handle 30, the connecting rod 40 actuates the movement of the movable jaw assembly 20. In this case, assuming that the fixed jaw assembly 14 is fixed in place, the movable jaw assembly with the movable jaw 21 approaches the fixed jaw 14, thereby a terminal (not shown) that is gripped on the die set 15 of the fixed jaw 14 is crimped by the die sets 15 and 22.

When the handle 30 and the handle 16 are in an "open" state as indicated in FIG. 5, the ratchet members 51 of the ratchet mechanism 50 do not interact with the stopper 52. As shown in FIG. 6, when the handle 30 is pressed by a user the stopper 52 snaps the ratchets 55 of the ratchet member 51 to position the crimp tool. The handle 30 is not released until that the handle 30 cannot be pressed further.

This invention provides a labor-saving and ergonomic mechanism of the crimp tool. The labor-saving mechanism of the crimp tool comprises the handle 30, the connecting rod 40, the fixed jaw assembly 10, and the movable jaw assembly 20. In use, the fixed jaw 14 is fixed, and only the movable jaw 21 moves. Hence, the terminal gripped by the die set 15 of the fixed jaw 14 may be precisely crimped onto a wire.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. An improved crimp tool, comprising:

a fixed jaw assembly having two connected halves defining a chamber therebetween, said fixed jaw assembly having two ends, one end forming a fixed jaw and the other end forming a first handle;

a movable jaw assembly pivotall connected to said fixed jaw assembly in said chamber, said movable jaw assembly having a movable jaw assembled on an upper end thereon;

a second handle having one end pivotally connected to said movable jaw assembly;

a connecting rod installed in said chamber and having two ends, said connecting rod having one end pivotally connected to the second handle and the other end connected to said fixed jaw assembly; and a ratchet mechanism installed between said fixed jaw assembly and said second handle, said ratchet mechanism including a pair of a ratchet members and a stopper, each of said ratchet members having one end pivotally engaged within a semicircularly-shaped recess of said second handle and a guiding groove coupled to a guiding piece pivotally mounted on said fixed jaw assembly, said guiding piece having an eccentric-axle and an adjusting wheel device formed on one end, one of said ratchet members having a plurality of ratchets formed thereon, said stopper being pivotally mounted on said fixed jaw assembly with a stopper pivot pin, said stopper being connected to a first flexible device, said first flexible device having one end thereof connected to said fixed jaw assembly.

2. The improved crimp tool of claim 1 wherein a first die set is installed on said fixed jaw and a second die set is installed on said movable jaw.

3. The improved crimp tool of claim 1 wherein said movable jaw assembly is pivotally mounted on said fixed jaw assembly with a first pivot pin.

4. The improved crimp tool of claim 3 wherein said second handle is pivotally mounted on said movable jaw assembly with a second pivot pin.

5. The improved crimp tool of claim 4 wherein said connecting rod has one end pivotally connects with said second handle with a third pivot pin and the other end pivotally connects with said fixed jaw assembly with a fourth pivot pin.

6. The improved crimp tool of claim 1 wherein said stopper is fixed on said stopper pivot pin, and said stopper pivot pin serves as a rotating button, and wherein when rotating said stopper pivot pin, said stopper selectively snaps said ratchets of said ratchet member or it disengages with said ratchets, and wherein a second flexible device is positioned between said ratchet member and said fixed jaw assembly.

* * * * *